US005769727A

United States Patent [19]

Fair et al.

[11] Patent Number: 5,769,727

[45] Date of Patent: Jun. 23, 1998

[54] SWING

[75] Inventors: Paul F. Fair, Denver; Mark D. Jankowski, Thornton, both of Colo.

[73] Assignee: Lisco, Inc., Tampa, Fla.

[21] Appl. No.: 774,217

[22] Filed: Dec. 27, 1996

[51] Int. Cl.[6] ..... A63G 9/00

[52] U.S. Cl. ..... 472/118; 472/119

[58] Field of Search ..... 472/118, 119, 472/120, 125; 297/463.2, 158.3, 310; 248/129; 5/93.1, 106

[56] References Cited

U.S. PATENT DOCUMENTS

| | | | |
|---|---|---|---|
| D. 250,861 | 1/1979 | Boudreau et al. | D6/10 |
| D. 264,148 | 5/1982 | Gebhard | D6/4 |
| D. 293,046 | 12/1987 | Riehm | D6/347 |
| D. 348,157 | 6/1994 | Amburgey et al. | D6/345 |
| D. 349,819 | 8/1994 | Noll | D6/347 |
| D. 351,289 | 10/1994 | Stephens et al. | D6/344 |
| 1,282,927 | 10/1918 | Paskal . | |
| 1,439,619 | 12/1922 | Dziedzic . | |
| 1,458,049 | 6/1923 | Grieshaber . | |
| 1,505,049 | 8/1924 | Mason . | |
| 1,505,117 | 8/1924 | Withun . | |
| 1,906,768 | 5/1933 | Romine . | |
| 2,024,855 | 12/1935 | Goetter | 155/59 |
| 2,076,675 | 4/1937 | Sharp | 5/61 |
| 2,561,547 | 7/1951 | Warren | 260/521 |
| 2,564,547 | 8/1951 | Schrougham | 155/59 |
| 2,609,031 | 9/1952 | Puscas | 155/59 |
| 2,807,309 | 9/1957 | Saint et al. | 155/59 |
| 2,908,917 | 10/1959 | Pinson | 5/109 |
| 2,972,152 | 2/1961 | Vincent | 5/109 |
| 2,979,734 | 4/1961 | Saint et al. | 5/109 |
| 3,025,058 | 3/1962 | Brumfield | 248/129 X |
| 3,071,339 | 1/1963 | Saint | 248/165 |
| 3,128,076 | 4/1964 | Pasqua | 248/370 |
| 3,146,985 | 9/1964 | Grudoski | 248/370 |
| 3,166,287 | 1/1965 | Pasqua | 248/370 |
| 3,459,423 | 8/1969 | Meade | 248/370 |
| 3,526,400 | 9/1970 | Carpenter et al. | 472/119 |
| 3,692,305 | 9/1972 | Allen | 472/119 |
| 3,818,517 | 6/1974 | Casella | 5/105 |
| 3,842,450 | 10/1974 | Pad | 5/109 |
| 3,985,436 | 10/1976 | Tanaka et al. | 355/8 |
| 4,150,820 | 4/1979 | Bochmann | 472/119 |
| 4,211,401 | 7/1980 | Cunard | 472/119 |
| 4,240,625 | 12/1980 | Meeker | 472/119 |
| 4,323,233 | 4/1982 | Gebhard | 472/119 |
| 4,452,446 | 6/1984 | Saint | 472/119 |
| 4,491,317 | 1/1985 | Bansal | 472/119 |
| 4,500,195 | 2/1985 | Hosono | 355/3 R |
| 4,540,268 | 9/1985 | Toyono et al. | 355/3 R |
| 4,627,701 | 12/1986 | Onoda et al. | 355/3 CH |
| 4,722,521 | 2/1988 | Hyde et al. | 472/119 |
| 4,785,678 | 11/1988 | McGugan et al. | 74/42 |
| 4,805,902 | 2/1989 | Casagrande | 472/119 |
| 4,807,872 | 2/1989 | Spilman et al. | 472/119 |
| 4,822,033 | 4/1989 | Kohus et al. | 472/119 |
| 4,911,429 | 3/1990 | Ogbu | 472/119 |
| 4,974,284 | 12/1990 | Campbell | 297/158.3 X |
| 5,036,358 | 7/1991 | Yoshida | 355/203 |
| 5,051,778 | 9/1991 | Watanabe et al. | 355/200 |
| 5,115,272 | 5/1992 | Ohmori et al. | 355/200 |
| 5,126,800 | 6/1992 | Shishido et al. | 355/211 |
| 5,134,441 | 7/1992 | Nagata et al. | 355/245 |
| 5,151,734 | 9/1992 | Tsuda et al. | 355/200 |
| 5,208,634 | 5/1993 | Ikemoto et al. | 355/215 |
| 5,223,893 | 6/1993 | Ikemoto et al. | 355/200 |
| 5,259,612 | 11/1993 | Matherne et al. | 273/1.5 R |
| 5,289,233 | 2/1994 | Sakamoto et al. | 355/200 |
| 5,326,326 | 7/1994 | Cunard et al. | 472/118 |
| 5,326,327 | 7/1994 | Stephens et al. | 472/119 |
| 5,378,196 | 1/1995 | Pinch et al. | 472/119 |
| 5,525,113 | 6/1996 | Mitchell et al. | 472/119 |

FOREIGN PATENT DOCUMENTS

| | | | |
|---|---|---|---|
| 1070921 | 6/1967 | United Kingdom | A63G 9/16 |

*Primary Examiner*—Kient T. Nguyen

*Attorney, Agent, or Firm*—Robert G. Crouch; Holland & Hart, LLP

[57] ABSTRACT

A swing with a pivotably attached tray for pivotable movement about a generally vertical axis, a vibrating mechanism attachable to a seat bottom of the swing, wheels mounted on a frame for selective engagement with the floor when the frame is tilted back when grasping a pair of handles on the frame, a lost motion coupling mechanism for a motorized drive mechanism, and a reclinable seat with an adjustment wire for selecting different reclined positions.

4 Claims, 9 Drawing Sheets

SWING

The present invention relates to an improved swing for children, and in particular, to an improved swing with an improved mechanism for pivoting, removing, and latching a tray thereto, an improved swing with additional convenience features including a technique for imparting vibrating motion to the swing, an improved technique for transporting the swing, and an improved technique for adjusting the angle of recline of the swing seat, as well as an improved swing with an improved drive mechanism.

BACKGROUND OF THE INVENTION

Historically, swings for very young children have included a support frame with side frame members supporting a horizontal housing from which a seat is hung. Early swings were mechanically driven through a wind-up/spring mechanism while more modern swings include motorized drive mechanisms which are electrically powered. More modern frame designs are referred to as open-top swing designs and typically include front and back frame members connected together by separate connectors at upper ends thereof. The drive mechanism is typically housed in one of the connectors connecting the upper ends of the front and rear frame members. Unfortunately, such drive mechanisms tend to be overly complex and are not optimal.

Typical modern swing designs provide several safety and convenience features including a feature known as "lost motion" coupling. This type of coupling involves indirectly coupling the drive motor to the swinging seat so that if the motion of the swinging seat is halted by an operator such as an adult or an older sibling while the motor is still attempting to swing the seat, the motor and drive mechanism will not be damaged by holding the seat stationary. Another common feature is an adjustable control for selecting from a plurality of amplitudes or speeds for the swing. Unfortunately, techniques for achieving the lost motion control and the amplitude/speed control of the swing are often overly complex. It is desired to improve such control techniques.

One drawback with open top swings is that it can sometimes be cumbersome to transport such swings about a room or house since most open top swings have a fixed frame which is not easily collapsible. Transportation of the swing may be desired for short- or long-term storage of the swing or to relocate the swing to another portion of the room or house. It would be desirable to improve the transportability of such swings.

While many swings will comfort most babies and gently rock them to sleep, some babies are born with a condition known as colic which irritates them and makes them uncomfortable. Additional stimulation or techniques are typically required to comfort and soothe such babies. It would be desirable to apply such techniques to swings.

In order to help to restrain infants in the seat of the swing and in order to provide a suitable surface for older infants to play with or rest objects on, trays are provided on many swings. Typically, such trays are either fixed in place relative to the seat of the swing or else they pivot about a horizontal axis and thus pivot down into position over the infant's legs. Such arrangements are not always desirable and a more convenient arrangement is desired. In addition, it is desirable to have trays for swings meet the safety standards promulgated by United States and European safety organizations for trays on high chairs.

Lastly, most swing seats are disposed at a fixed angle relative to the frame and the ground or, in some cases, are adjustable between two different reclined positions. In the case of such adjustable swings, the adjustment mechanisms are sometimes cumbersome to operate and some may not be able to be operated while the infant is in the swing.

It is against this background and the desire to solve the problems of the prior art that the present invention has been developed.

SUMMARY OF THE INVENTION

The present invention is also directed to a swing for a child including a support structure, the support structure including at least two floor-contacting members, each floor-contacting member having a floor-contacting surface thereon and a wheel rotatably mounted on the floor-contacting member in a position to support the swing structure with the floor-contacting surface when the swing may be in an operational position and to support the structure with the wheels when the swing is in a transporting position. The swing also includes a child support attachable to the support structure. The swing may further include handles disposed on the support structure on an opposite side from the wheels to facilitate the moving of the swing between the operational and transporting positions.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
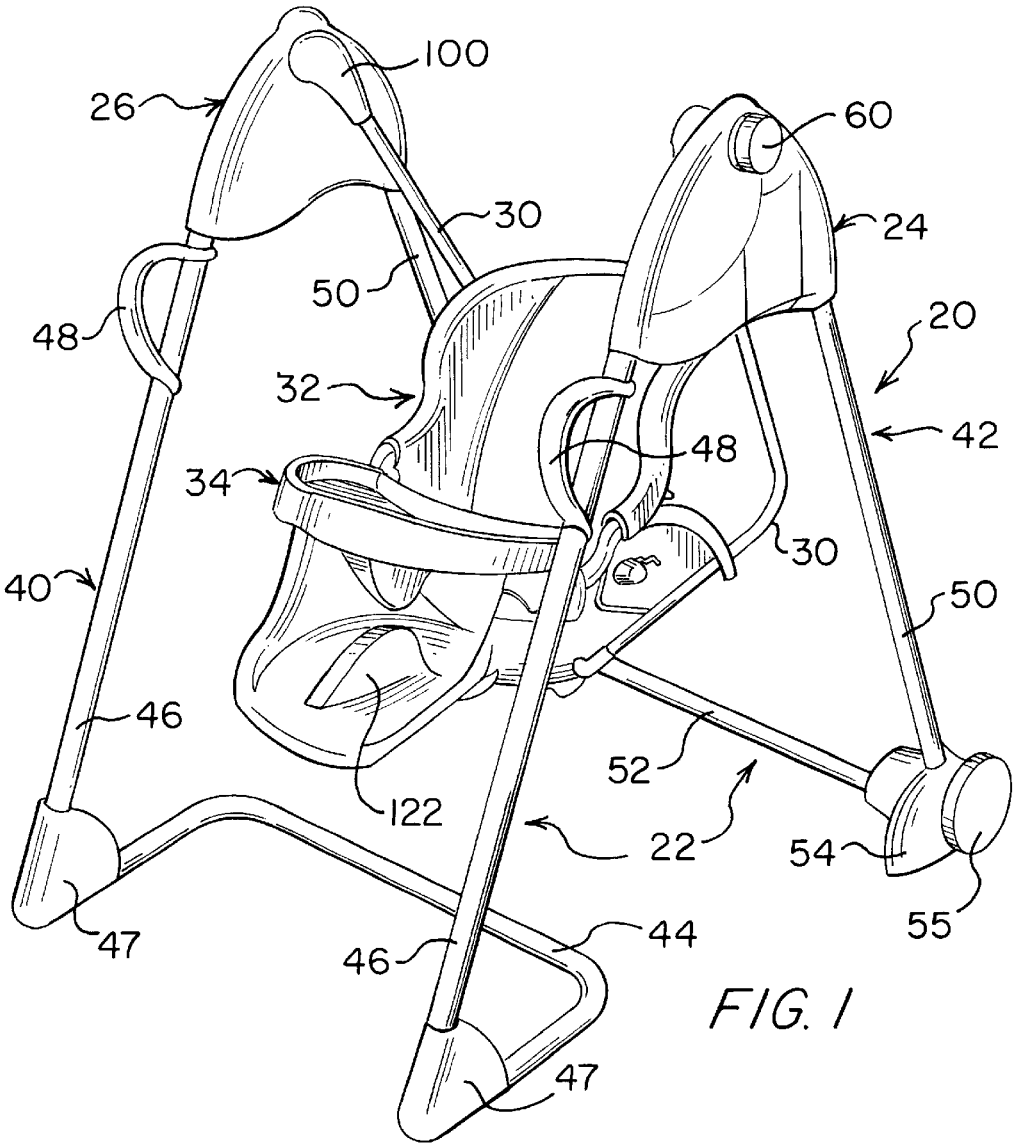
FIG. 1 is a perspective view of the improved swing of the present invention.
Figure 12:
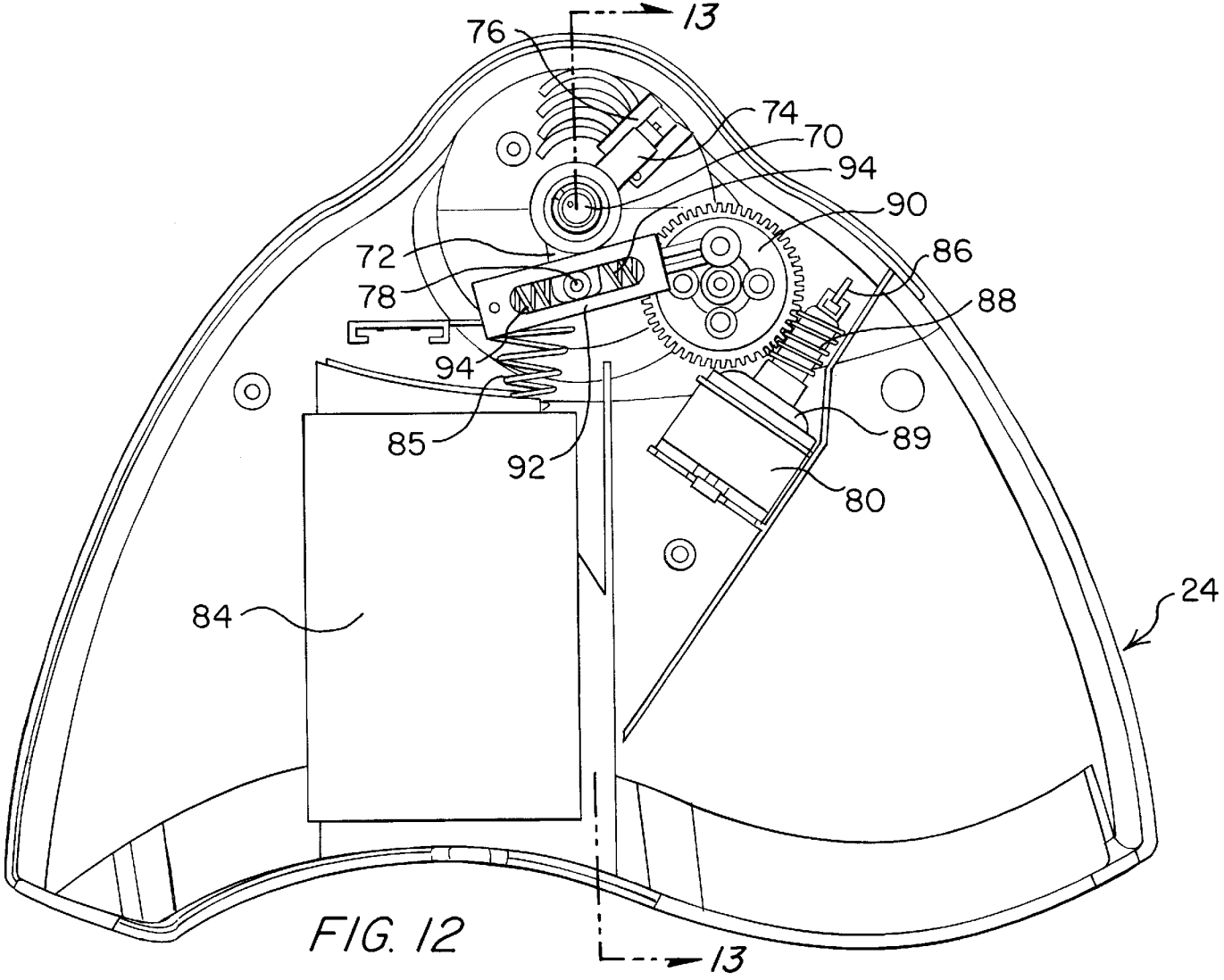
FIG. 12 is a side view of a drive mechanism of the improved swing of FIG. 1.
Figure 13:
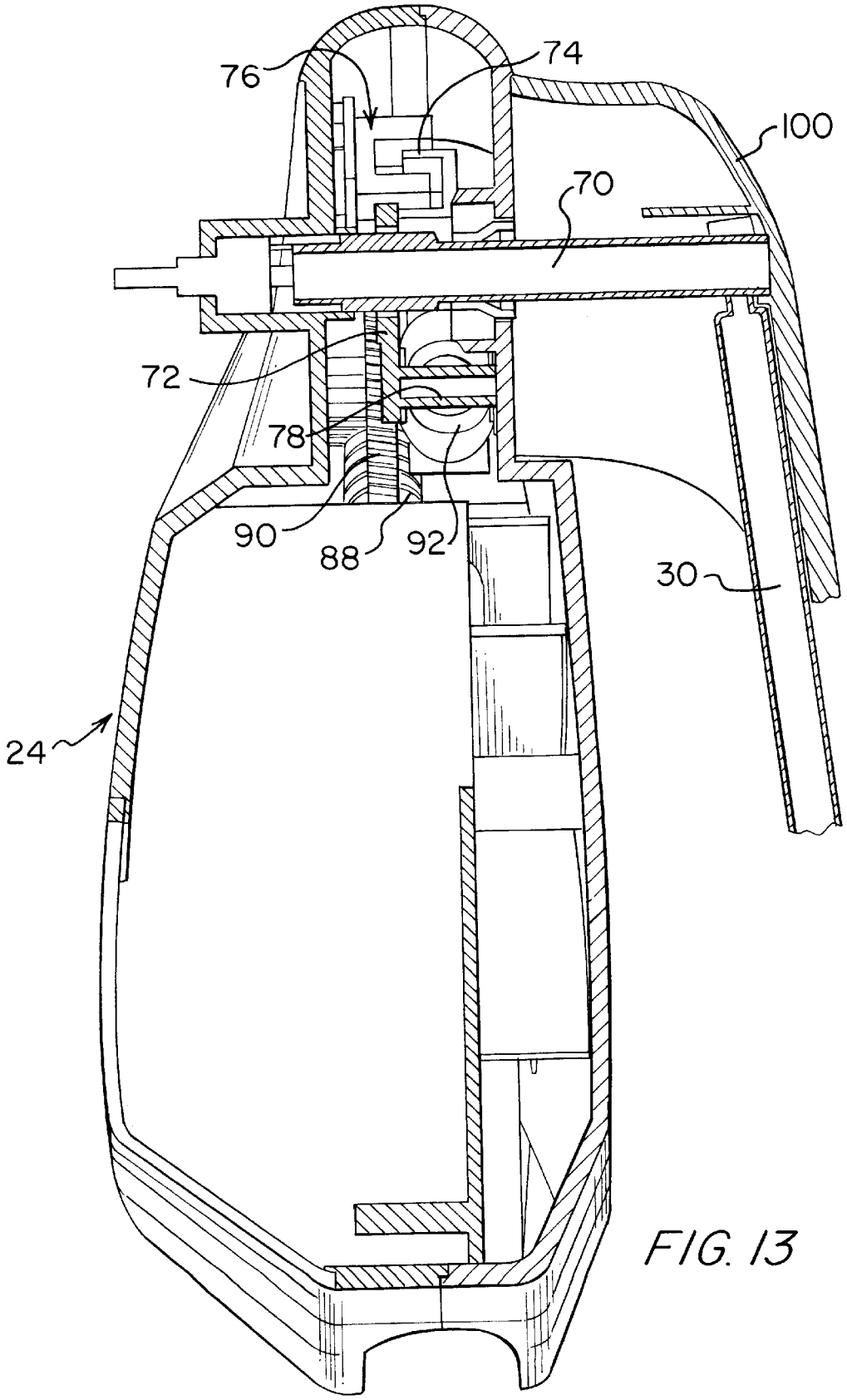
FIG. 13 is a cross-sectional view taken substantially along line 13—13 of FIG. 12.
Figure 14:
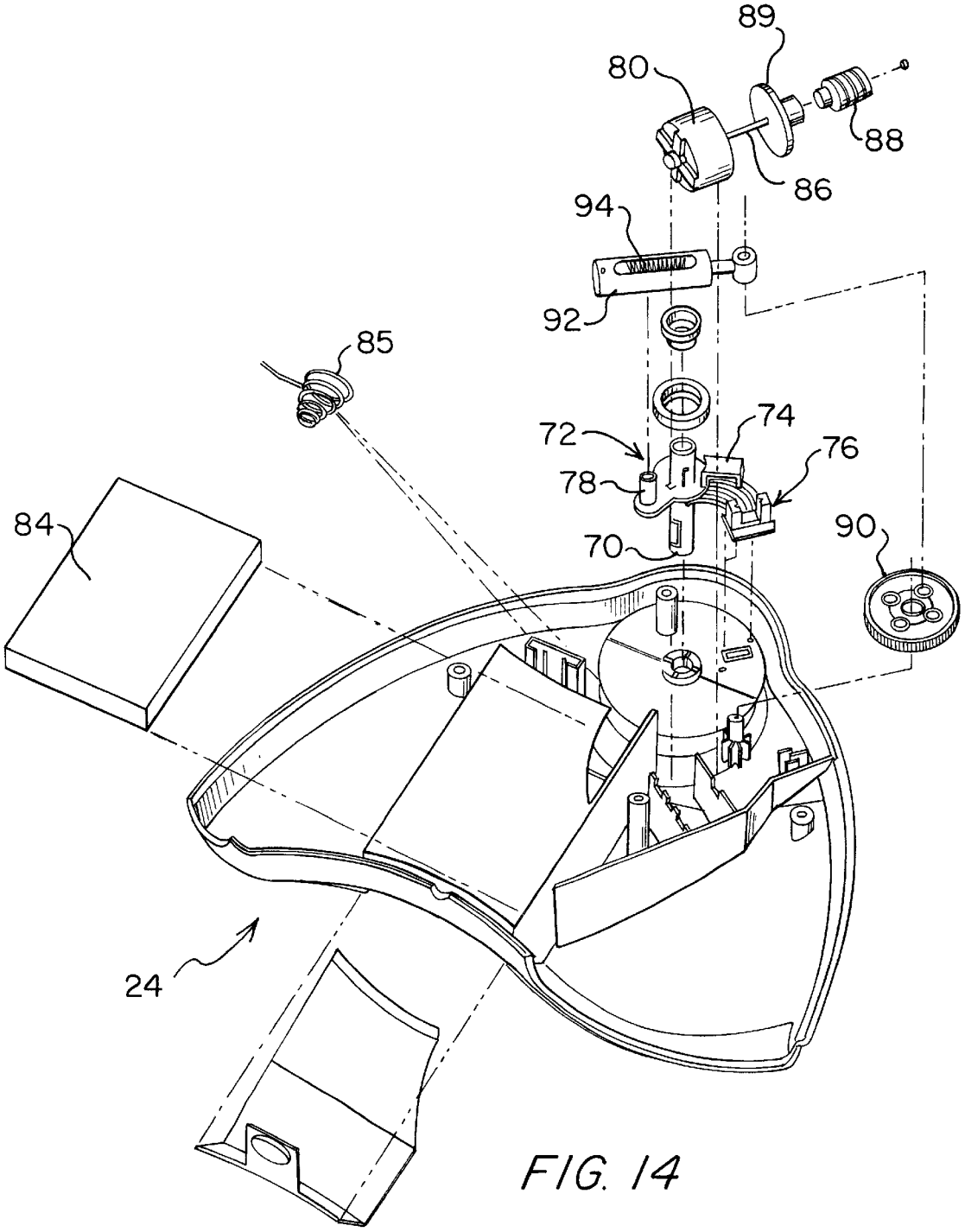
FIG. 14 is an exploded perspective view of the drive mechanism of FIG. 12.

A swing 20 constructed according to the principles of the present invention is shown in FIG. 1. The swing 20 generally includes a frame 22, a pair of connectors 24 and 26 for interconnecting the frame 22, a drive mechanism 28 (FIGS. 12–14) contained within the connector 24, a pair of hanger arms 30 suspended from the connectors 24 and 26, a seat 32 supported for arcuate motion by the hanger arms 30, and a tray 34 removably and pivotably attached to the seat 32.

Figure 10:
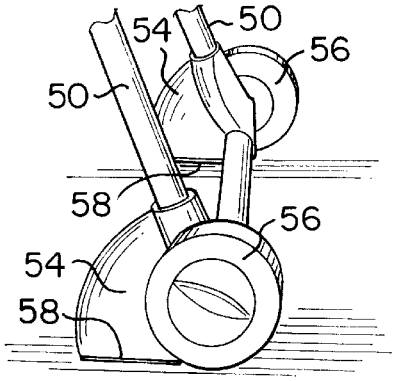
FIG. 10 is a perspective view of a pair of wheels of the improved swing of FIG. 1, showing the wheels slightly above the ground in a non-supporting position when the swing is in a stationary, operational position.
Figure 11:
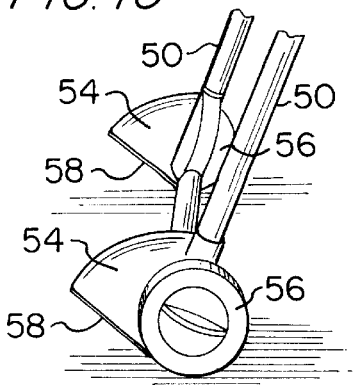
FIG. 11 is a view similar to FIG. 10, showing the wheels contacting the ground in a supporting position when the swing is in a transporting position.

The frame 22 includes a front frame member 40 and a rear frame member 42 as shown in FIG. 1. Preferably, these frame members 40 and 42 are composed primarily of steel tubes, but other materials of suitable strength and rigidity may be used as well. The front frame member 40 includes a generally U-shaped portion 44 connected to a pair of support legs 46 by front feet 47, which together with portion 44 have bottom surfaces suitable for engagement with the floor, ground, or other suitable support surface. Handles 48 are provided, one on each of the support legs 46. The rear frame member 42 includes a pair of support legs 50 and a crossbar 52. The crossbar 52 is connected to each of the support legs 50 by a pair of rear feet 54, one for each of the support legs 50. Rotatably mounted on each of the rear feet is a wheel 56, as seen best in FIGS. 10 and 11. The rear feet 54 have a bottom surface 58 thereon suitable for engagement with the floor, ground, or any other suitable support surface. The distance of the rotatable mounting of the wheels 56 from the bottom surface 58 of the rear feet 54 is slightly greater than the radius of the wheels 56. This positioning of the wheels 56 allows the bottom surface 58 of the rear feet 54 to support the frame 22 and the swing 20 when the swing 20 is in a stationary position ready for operation without risk that the wheels 56 will engage the support surface and permit rolling movement of the swing 20. When, however, the entire swing 20 is tilted sufficiently, preferably via the handles 48, the wheels 56 come into contact with the floor, ground, or other support surface. If the swing 20 is tilted further, the wheels 56 entirely support the swing 20. In this transporting position, the swing 20 can be easily transported about the room, house, or other location. The feet 47 and 54 may be composed of a plastic, such as a polypropylene copolymer, but other suitable materials may be used also.

The connectors 24 and 26 (FIGS. 1 and 12–14) are housings composed of a plastic, such as ABS or other suitable material. The front and rear frame members 40 and 42 are connected together by separate connection to the connectors 24 and 26. As will be described in further detail below, the connector 24 houses the drive mechanism 28 therewithin. For controlling the operational amplitude and speed of the swing 20, the connector 24 has a control knob 60 rotatably mounted on an outside surface thereof and operationally associated with the drive mechanism 28.

The drive mechanism 28 (FIGS. 12–14) is operative to drive the hanger arms 30 to swing the seat 32 back and forth. Each of the hanger arms 30 are affixed to an axle 70 which is journaled for rotation in the corresponding connector 24 and 26 in a conventional manner. A lever 72 is affixed to the axle 70 for imparting pivotable motion thereto. The lever 72 has a lever blade or flag 74 associated therewith which is located in a position to swing in and out of a blocking position for a light switch 76, which forms part of a control circuit regulating the swinging movement of the seat 32. The light switch 76 is of conventional construction, including a light source such as an infrared light emitting diode (LED) and a light detector such as a phototransistor (e.g., industry standard part number OPB804 such as is available from Optek and several other manufacturers) disposed at a spaced-apart distance from each other. Preferably, the light source and light detector are encased in a conventional plastic which allows infrared light to pass therethrough and substantially blocks visible light from passage therethrough to reduce unwanted signals from ambient light. When the lever flag 74 is in a blocking position between the light source and the light detector, the light detector does not receive a signal from the light source, and when the lever flag 74 is not in a blocking position, the light detector does receive a signal from the light source. The blocking position may include a thirty degree span (plus or minus fifteen degrees) centered about the rest position for the hanger arms 30. The lever 72 also includes a lever pin 78 at an end thereof spaced apart from the attachment of the lever 72 to the axle 70. The electronic circuit 84 is designed to operate with or tolerate a wide variety of light detectors, so any of various different standard detectors could be used.

The drive mechanism 28 (FIGS. 12–14) also includes a drive motor 80 powered by a battery 82 as controlled by an electronic circuit 84. The battery 82 may preferably include four D-size batteries (not shown) held in place by one or two springs 85. The drive motor 80 includes a drive shaft 86 through which it provides its motive power. A worm gear 88 and a flywheel 89 are coupled to the drive shaft in a conventional manner. The worm gear 88 mates with a toothed wheel 90 which has an axis of rotation normal to the axis of rotation of the drive shaft 86. Pivotably mounted to the toothed wheel 90 is an elongated slotted housing 92 which has the lever pin 78 retained within the slot of the housing 92. The elongated slotted housing 92 also includes a pair of springs 94 retained therein at either end of the elongated slotted housing 92. The toothed wheel 90 and elongated slotted housing 92 operate in a fashion which is the reverse of the power train of a locomotive engine in which reciprocal motion is converted into rotational motion. In this case, the rotational motion of the toothed wheel is converted into reciprocal motion of the elongated slotted housing 92 and lever pin 78. In their relaxed state, the proximal ends of the springs 94 are spaced apart a distance which is significantly greater than the diameter of the lever pin 78 so that not all of the reciprocal motion of the elongated slotted housing 92 and springs 94 is converted into reciprocal motion of the lever pin 78. In this manner, the drive motor 80 along with the worm gear 88 and toothed wheel 90 are only loosely or intermittently coupled to the lever 72, axle 70, and hangar arms 30 of the swing. This accomplishes a lost motion effect which is desired in motorized swings. The lever 72, the slotted housing 92, and the worm gear 88 are composed of a plastic, such as Delrin or other suitable material.

Figure 15:
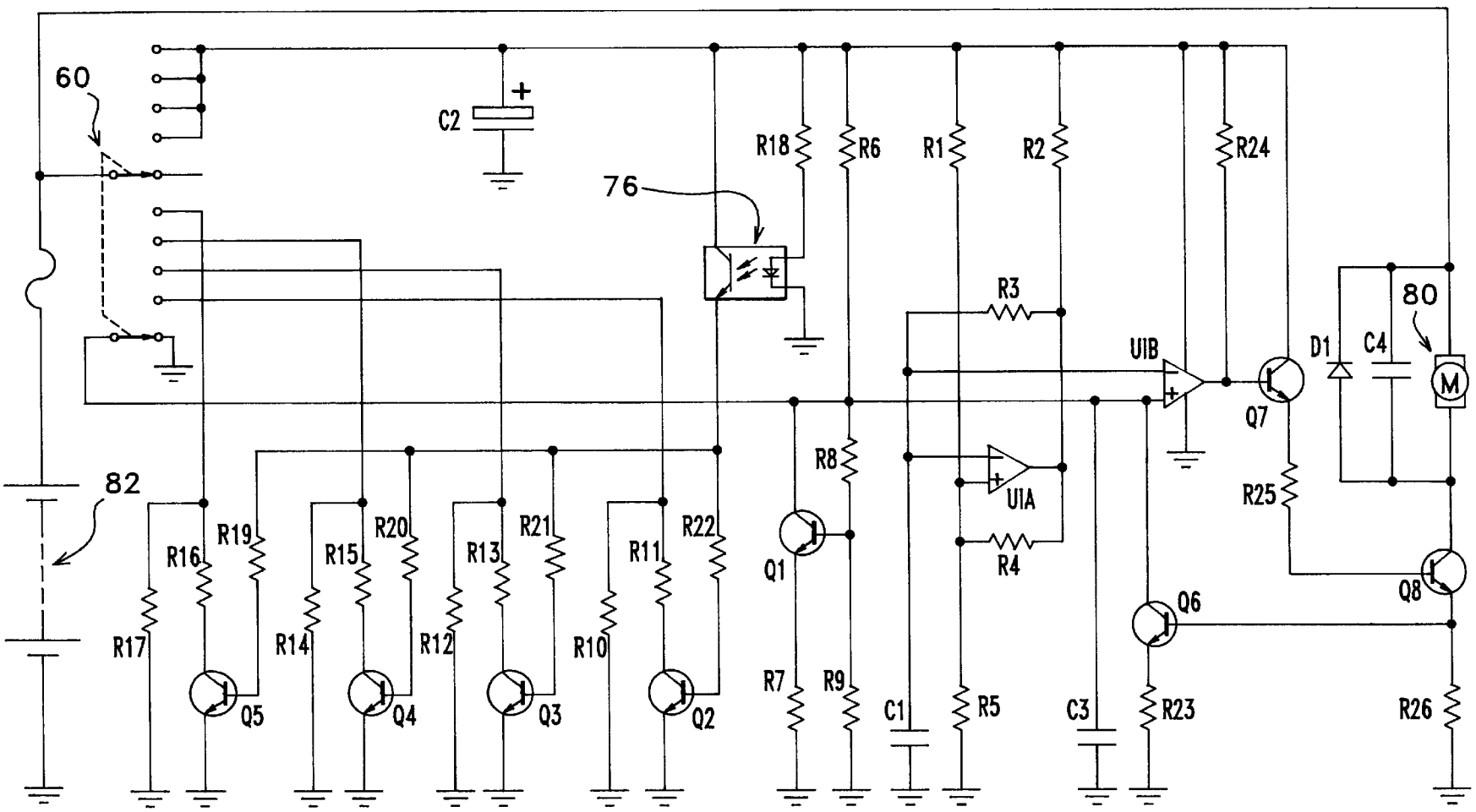
FIG. 15 is a schematic diagram of an electronic circuit that may be used to control the operation of the improved swing of FIG. 1.

The electronic circuit 84 (FIG. 15) receives power from the battery 82, and inputs from the light detector of the light switch 76, and from the control knob 60. The electronic circuit 84 powers the light source of the light switch 76 and provides a drive signal to the drive motor 80. The control knob 60, together with four selection transistors Q2, Q3, Q4, and Q5, serve to select which resistor(s) are attached as a load to the collector of a transistor Q1 acting as a $V_{BE}$ multiplier. These resistors may be R10 and R11 for a first speed setting of the control knob 60, R12 and R13 for a second speed setting, R14 and R15 for a third speed setting, and R16 for a fourth speed setting. Resistors R11, R13, R15, and R16 will only load the $V_{BE}$ multiplier Q1 when the light switch 76 is not blocked. When the light switch 76 is blocked, the transistors Q2, Q3, Q4, and Q5 serve to prevent resistors R11, R13, R15, and R16, respectively, from loading the $V_{BE}$ multiplier Q1. Thus, in the blocked position of the light switch 76, the load resistors will be R10 for a first speed setting of the control knob 60, R12 for a second speed setting, R14 for a third speed setting, and no load for a fourth speed setting. The control knob 60 is either a single-pole five-throw rotary switch or a similar switch implemented on a PCB board. Alternatively, the selection transistors Q2, Q3, Q4, and Q5 could be replaced with a single transistor (not shown).

The lower the resistive load attached between the collector of the $V_{BE}$ multiplier Q1 and the negative battery terminal, the lower the drive signal to the motor 80 will be. Normally, the $V_{BE}$ multiplier Q1 generates approximately 2.65 volts at its collector. As is discussed in more detail below, the $V_{BE}$ multiplier Q1 helps to make the drive signal to the motor 80 independent of the battery voltage within the range of battery voltages between five and six volts.

An oscillator operating at approximately five kilohertz (kHz) is provided by the comparator U1A and biasing components R1 through R5 and C1. The output of this oscillator, in the form of a triangular waveform varying between approximately 1.45 volts and 2.75 volts (when the battery is at 5.5 volts, which is an intermediate point in the life of the batteries) at approximately five kHz and provided by the inverting input of the comparator U1A, is supplied to the inverting terminal of a second comparator U1B. As can be appreciated, the minimum and maximum values of the triangular waveform are based on the instantaneous voltage from the battery 82, at approximately twenty-six percent of the battery voltage for the minimum and forty-eight percent of the battery voltage for the maximum.

The non-inverting terminal of the second comparator U1B is attached to the collector of the $V_{BE}$ multiplier Q1. Essentially, this comparator U1B compares the instantaneous value of the triangular waveform to the DC value on the collector of the $V_{BE}$ multiplier Q1 and uses this comparison to provide a motor drive signal when the magnitude of the triangular waveform is less than the DC value, while not providing a motor drive signal when the magnitude of the triangular waveform is greater than the DC value. This arrangement, together with the motor drive circuitry, provides a pulse-width-modulated (PWM) signal to the motor 80. This means that the signal to the motor 80 is always of approximately the same amplitude (the full battery voltage less small efficiency losses), but that the length of time that the signal is active varies to achieve different swing speeds. The duty cycle (percentage of time an active signal is provided) may vary from sixty-six to ninety percent with fully-charged batteries. As the battery voltage gradually drops off from its normal six volts (with four fully charged 1.5 volt batteries) toward five volts, the magnitude of the motor drive signal will decrease proportionately, but the duty cycle of the drive signal to the motor 80 will increase proportionately (to seventy-three to one hundred percent) and thus the operation of the swing 20 will not be effected by the battery voltage.

The motor drive circuitry includes a drive transistor Q8 that is always either saturated or off. Because the output current of the second comparator U1B is of such small magnitude, a transistor Q7 is connected in Darlington fashion between the output of the second comparator U1B and the base of the drive transistor Q8. The negative terminal of the motor 80 is connected to the collector of the drive transistor Q8 while the positive terminal of the motor 80 is connected to the positive terminal of the battery 82. In order to prevent a high voltage transient when the motor current is turned off instantaneously, a diode D1 and a capacitor C4 are provided in parallel with the positive and negative terminals of the motor 80. Absorbing such transient signals serves to protect transistor Q8 and avoid undesired electrical braking of the motor 80. A capacitor C2 is connected across the battery terminals just before the connection to the motor terminals to store sufficient charge for the high frequency (approximately 5 kHz) signals to the drive motor so that the characteristics of the wires from the battery do not limit the signal to the motor 80.

In order to further protect the drive transistor Q8, a current limiting technique employs a transistor Q6 with a base connected to the emitter of the drive transistor Q8. A resistor R26 between this point and the negative battery terminal is of a very small resistance (approximately two ohms) so the transistor Q6 is normally off. When sufficiently high current flows through resistor R26, however, Q6 will turn on and serve to effectively lower the DC voltage at the noninverting terminal of the second comparator U1B, thus reducing the duty cycle and, accordingly, the current flow through the drive transistor Q8 and resistor R26. Such conditions might occur if the motor stalls or shorts and is drawing high current. Typically, this would be a temporary condition. This current limit feature will automatically disable itself and allow the motor drive circuitry to return to normal operation when the short or stall ends.

It should be understood that a typical ideal $V_{BE}$ multiplier will not drop in voltage as battery voltage drops. In this case, however, resistor R7 has been added to make this $V_{BE}$ multiplier non-ideal so that its output voltage does drop slightly as the battery voltage drops. The value of R7 is chosen so that the $V_{BE}$ multiplier output voltage drops more slowly than the voltage of the triangular waveform as the battery 82 wears out and exactly adjusts the duty cycle to compensate for the battery voltage drop and keeps the average voltage to the motor constant. As can be appreciated, the electronic circuit 84 of the swing 20 has at least two significant advantages. First, the arrangement of the $V_{BE}$ multiplier Q1 and the second comparator U1B to make the drive signal to the motor 80 independent of the battery voltage is advantageous as the operation of the swing 80 will not be effected by the battery voltage (at least down to a voltage where the circuit may cease to function, in the range of five volts). Second, the arrangement of the selection transistors Q2 through Q5 and the control knob 60 allow for the easy modification of the circuit 84 to obtain nearly any desired swing amplitude/speed within a reasonable range.

Each hangar arm 30 is attached at one end thereof directly to the corresponding axle 70, as described above, and as is seen in FIG. 13. The hangar arms 30 bend at an angle greater than ninety degrees at a central portion thereon (FIG. 2) and are attached to the seat 32 at ends opposite from the end which connects to the axle 70. Each of the hangar arms 30 may also include a decorative housing 100 (FIGS. 1 and 13) mounted thereon in the vicinity of the connectors 24 and 26 for primarily aesthetic purposes as well as indicating that the arms 30 have been properly installed on the axles 70.

Figure 2:
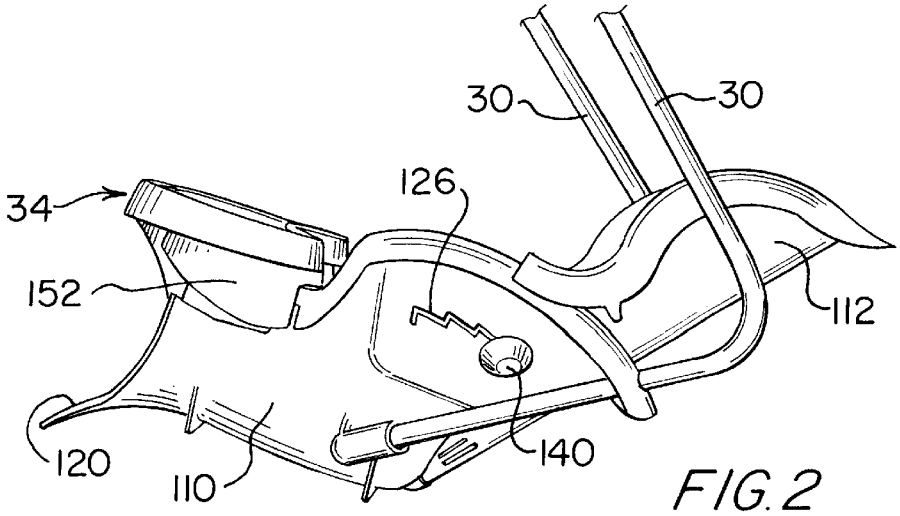
FIG. 2 is a side perspective view of a seat and hanger arms of the improved swing of FIG. 1, showing the seat in a fully reclined position.
Figure 3:
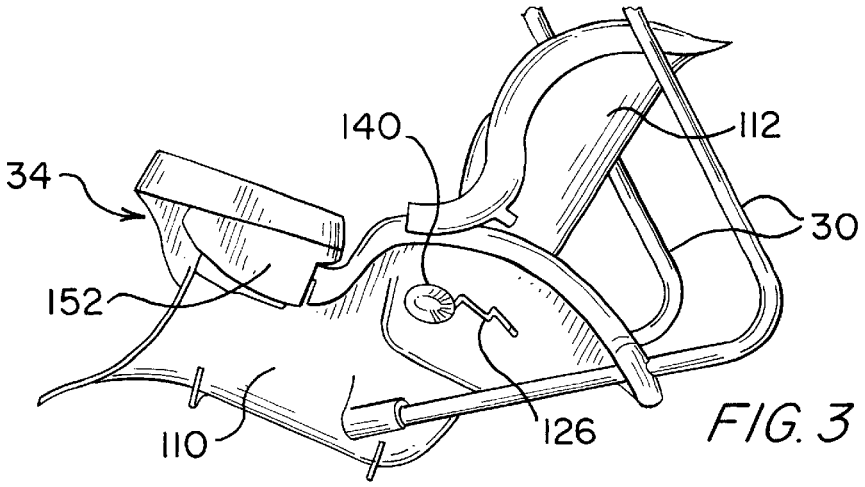
FIG. 3 is a view similar to FIG. 2, showing the seat in a fully upright position.
Figure 7:
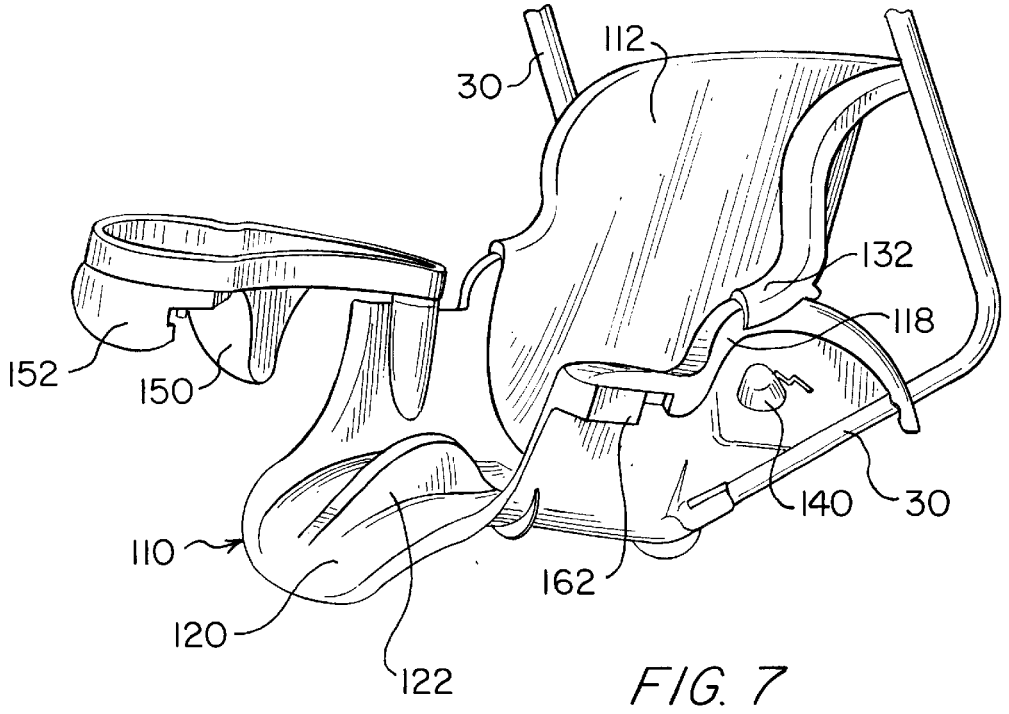
FIG. 7 is a front perspective view of the seat and hanger arms of the improved swing of FIG. 1, showing the tray pivoted horizontally away from the operational position through approximately a ninety-five degree angle.

The seat 32 (FIGS. 2–7) of the swing 20 is composed of two primary components, a seat base 110 and a seat back 112 which is pivotably connected to the seat base through a hinge 114 (FIGS. 2 and 3). The seat base 110 and seat back 112 are preferably formed from plastic, or other suitable material. A suitable and conventional fabric covering (not shown) may be provided for comfort purposes. As seen best in FIGS. 2, 3, 5, and 7, the seat base 110 includes sides 116 formed thereon with arm rests 118 along upper edges thereof. A lower central portion 120 of the seat base 110 is curved downward to provide a smooth edge to receive the infant (FIG. 7). A protruding tongue 122 is defined in and extends upward from the lower central portion 120 of the seat base 110 to define a wall separating the legs of a child positioned in the seat 32. The arm rest 118 on the right side of the seat 32 includes a cylindrical opening 124 (FIG. 9) defined therein to receive a portion of the tray 34 for connection thereto. On each of the sides 116, a serrated slot 126 is defined therein, as seen in FIGS. 2, 3, 5, and 6, which permits adjustment of the seat back 112 relative to the seat base 110. Lastly, each of the sides 116 include sleeves 128 and 130 (FIGS. 2–4 and 7) thereon for attaching the seat 32 to the ends of the hangar arms 30.

As best seen in FIGS. 1–4 and 7, the seat back 112 is generally curved about a substantially vertical axis so as to cradle the infant therein. Extending from the upper portion of the seat back 112 to a central portion thereon is a curled lip 132, a bottom edge of which rides on an upper edge of the sides 116 of the seat base 110. As the seat back 112 is pivoted relative to the seat base 110, this lower edge of the curled lip 132 is supported by the upper edge of the sides 116 of the seat base 110.

Figure 4:
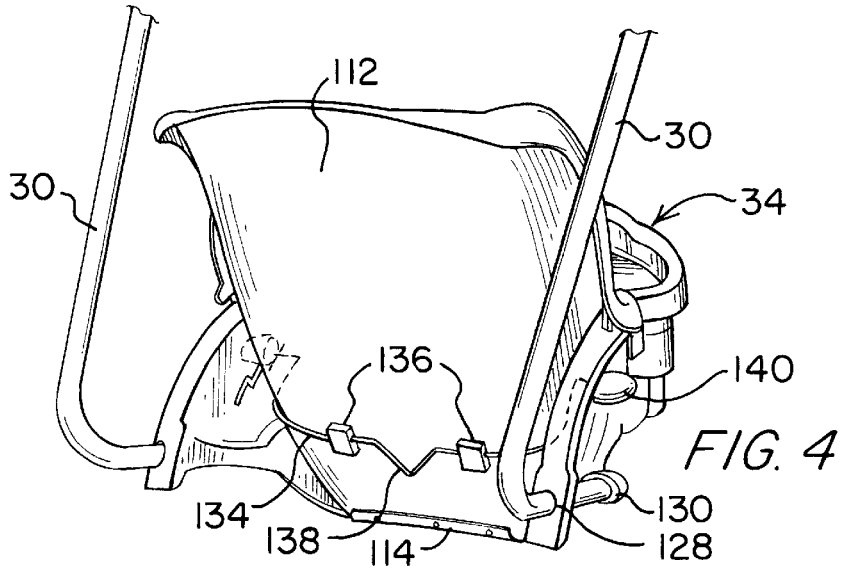
FIG. 4 is a rear perspective view of the seat and hanger arms of the improved swing of FIG. 1.
Figure 5:
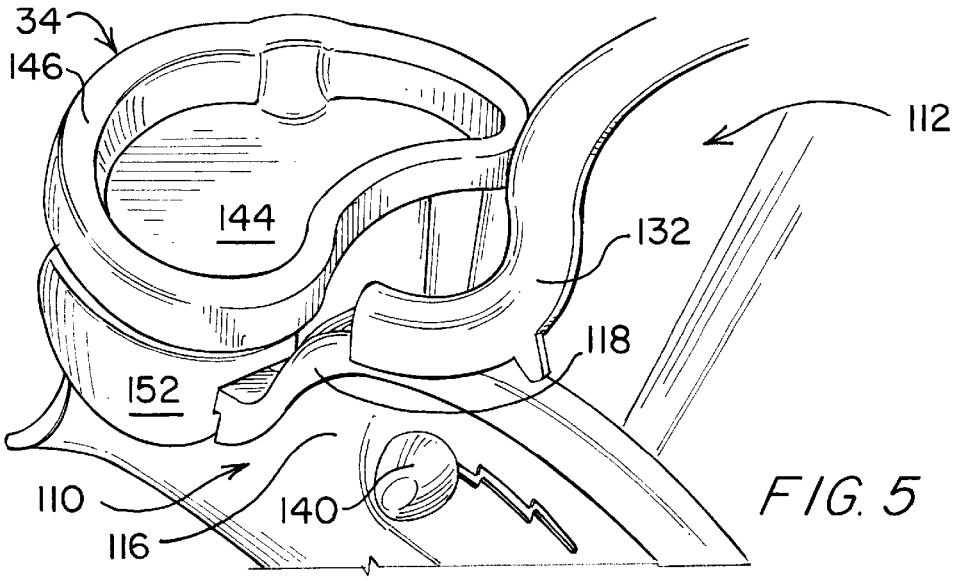
FIG. 5 is a close-up perspective view of a portion of the seat and a tray of the improved swing of FIG. 1.
Figure 6:
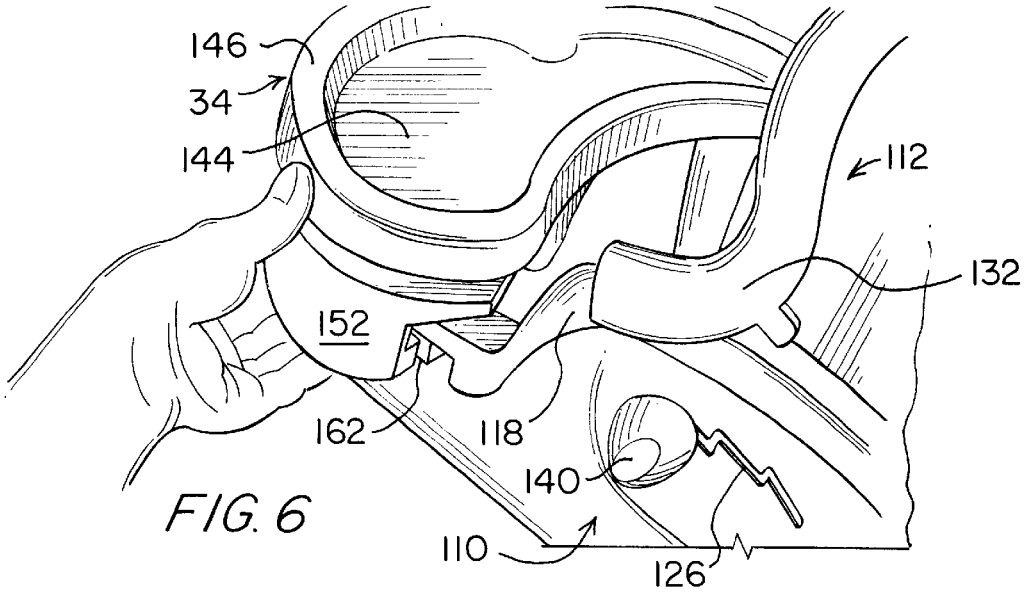
FIG. 6 is a view similar to FIG. 5, showing a latch on the tray being actuated to pivot the tray out of an operational position.

The angle of recline of the seat back 112 relative to the seat base 110 is adjustable by repositioning an adjustment wire 134 (FIG. 4) which supports the seat back 112 from therebehind. The adjustment wire 134 is received within pairs of resilient fingers 136 provided on the back of the seat back 112. The adjustment wire 134 is generally linear across the back of the seat back 112 with the exception of a downwardly extending portion or notch 138 formed in the wire 134 at an intermediate point between the fingers 136. The adjustment wire 134 curls around the seat back 112 as shown in FIG. 4, and engages with the serrated slots 126 formed in the sides 116 of the seat base 110. Adjustment knobs 140 (FIGS. 2–7) are provided on opposite ends of the adjustment wire 134 to facilitate repositioning the ends of the adjustment wire 134 within the serrated slot 126. As can be appreciated, by manipulating the adjustment knobs 140 to reposition the ends of the adjustment wire 134 into various different positions within the serrated slot 126, the seat back 112 can be correspondingly adjusted into a variety of different recline positions relative to the seat base 110. Because of the notch 138 and its engagement with the back surface of the seat back 112 relative to the positioning of the slot 126, the ends of the wire 134 must be moved out of their rest position to be received within the slot 126 and thus are biased downward when in the slot 126. When the ends are lifted up via the knobs 140 by an operator, the bias provided by the notch 138 resists the upward motion and forces the ends back down into engagement with the slots 126 when released. In the preferred embodiment, four different recline positions are available due to the nature of the serrated slot 126 (i.e., by the number of detent positions provided within the slot 126), but more or less positions may be provided. The seat base 110 and the seat back 112 may be composed of a plastic, such as high density polyethylene (HDPE), but other suitable materials may be used as well.

Figure 16:
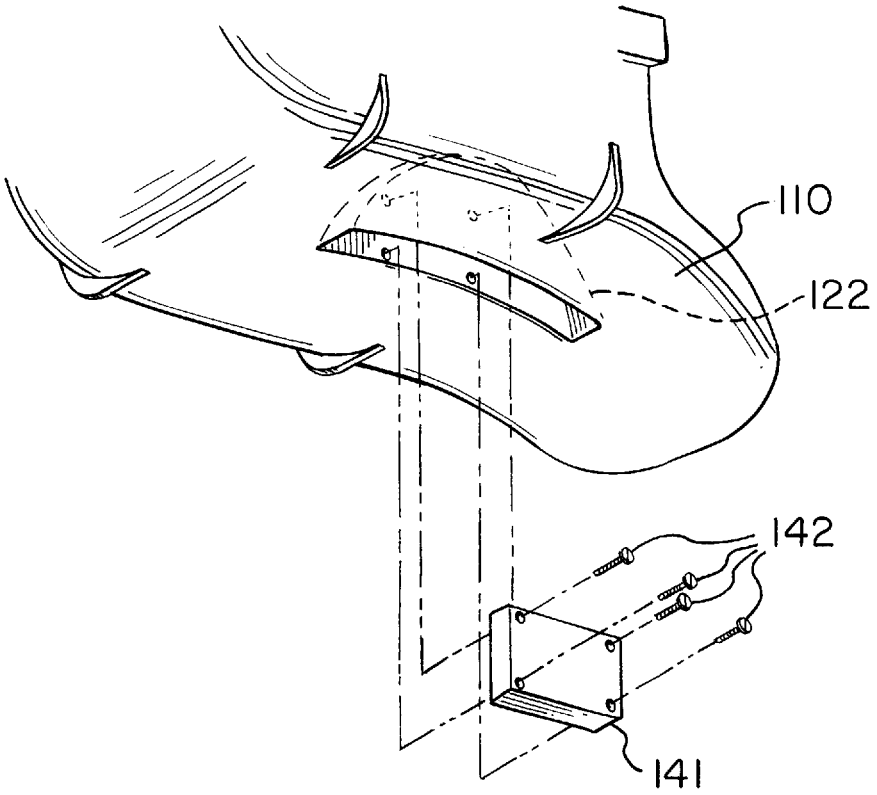
FIG. 16 is an exploded perspective view of the underside of the seat base, showing the attachment of a vibrating mechanism.

A vibrating mechanism 141 (FIG. 16) may optionally be attached to the underside of the seat base 110 in the recess formed by the upwardly-protruding tongue 122 by screws 142. The vibrating mechanism 141 is used to help soothe colicky/agitated infants, and includes a battery (not shown) and is more fully disclosed and discussed in U.S. patent application Ser. Nos. 07/942,423 and 08/492,241, which are assigned to the assignee of the present invention, and which are incorporated herein by reference.

Figure 8:
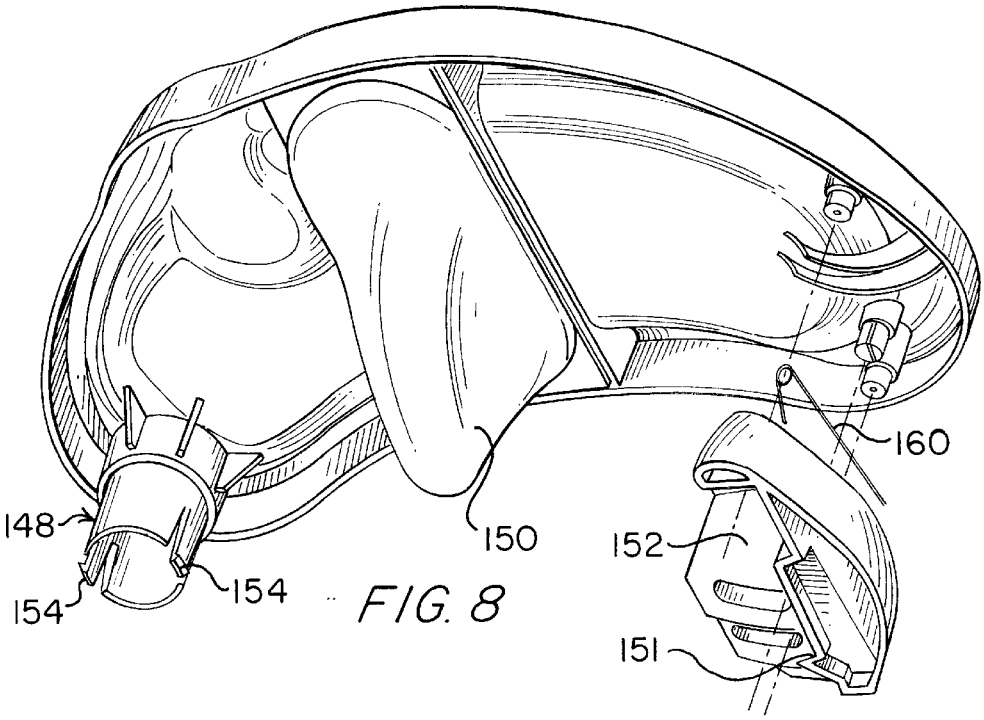
FIG. 8 is an exploded perspective view of the bottom of the tray of the improved swing of FIG. 1.
Figure 9:
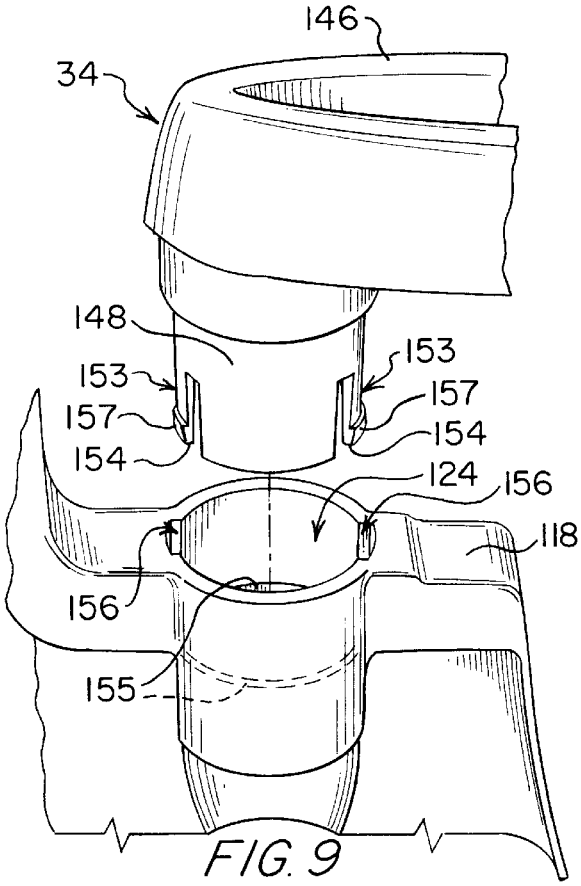
FIG. 9 is a close-up perspective view of a portion of the tray and its connection to the seat of the improved swing of FIG. 1.

The tray 34 (FIGS. 1–9) may be generally formed of a suitable plastic, such as a polypropylene copolymer. The tray has an upper support surface 144 (FIGS. 5 and 6) thereon with a raised lip 146 surrounding the upper support surface so as to assist in retaining objects on the upper support surface 144. Along the bottom of the tray 34, a cylindrical projection 148 (FIGS. 8 and 9) is formed on one side thereof for pivotable attachment to the seat 32 via a corresponding opening 124 as described subsequently. Also, a downwardly protruding center guard 150 may be formed on a central portion along the bottom of the tray 34 to correspond with the tongue 122 on the seat base 110 and substantially prevent the infant from sliding underneath the tray 34 to escape the seat 32. The cylindrical projection 148 is slotted to define yieldable tongues 153 having radially extending ends 154, as shown in FIGS. 8 and 9. The tongues 153 mate with keyed recesses 156 defined in the cylindrical opening 124 on the seat base 110. The inner surface of cylindrical opening 124 includes a circumferentially-extending slot 155 communicating with the bottom of diametrically-opposed recesses 156. The slot 155 is closed and captures the ends 154 of tongues 153 therein. Only when the ends 154 are aligned with recesses 156 may the tongues 153 be removed from the slot 155 due to a protruding lip 157 formed on each end 154. Once tongues 153 are received within the slot 155, the ends 154 may freely rotate therein about a vertical axis through the full circumferential extent of slot 155. Thus, the connection of the tongues 153 with the slot 155 supports the tray 34 for pivotable motion relative to the seat 32 in a generally horizontal plane about this vertical axis. The recesses 156 are located within opening 124 at a position such that the tray 34 can only be easily installed onto and removed from the seat 32 when the tray has been pivoted to a position generally ninety-five degrees rotated from an operational position. Moreover, the tray 34 cannot be removed from the seat 32 when the tray 34 is in an operational position, such as when latched to the seat 32 with a latch 152. Even if the tray 34 is not latched, it must be pivoted out of the operational position to the position where the tongues 153 align with the recesses 156 before the tray 34 can be removed.

Further, the latch 152 is provided on one side along the bottom of the tray 34 for engagement with one side 116 of the seat base 110. As shown best in FIGS. 5–8, the latch 152 is mounted on the tray 34 for limited pivotable movement relative to the underside of the tray 34. A torsion spring 160 (FIG. 8) biases the latch 152 inwardly. When the latch 152 is actuated against the bias of the spring 160, the tray can be pivoted in and out of the operational position. When released the latch will pivot, due to the bias of the spring 160 toward the tray 34 and a recess 151 receives a latch engagement surface 162 defined on the side 116 of the seat base 110 adjacent the arm rest 118 to lock the tray 34 in place when it is in the operational position.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The invention claimed is:

1. A swing for a child, comprising:

a support structure, the support structure including at least two floor-contacting members, each floor-contacting member having a floor-contacting surface thereon and a wheel rotatably mounted on the floor-contacting member in a position to support the swing structure with the floor-contacting surface when the swing is in an operational position and to support the structure with the wheels when the swing is in a transporting position; and a child support attachable to the support structure.

2. A swing as defined in claim 1, further including handles disposed on the support structure on an opposite side from the wheels to facilitate the moving of the swing between the operational and transporting positions.

3. A swing as defined in claim 1, wherein the wheel of each floor-contacting member is mounted for rotation about a rotational axis, wherein the position in which the wheel is mounted on the floor-contacting member places the rotational axis at a distance from the floor-contacting surface that is greater than the radius of the wheel.

4. A swing as defined in claim 1 wherein the swing can be moved between the operational and transporting positions by tilting the swing sufficiently until the wheel of each floor-contacting member supports the swing.

* * * * *